US012507834B2

(12) United States Patent
Meyer et al.

(10) Patent No.: US 12,507,834 B2
(45) Date of Patent: Dec. 30, 2025

(54) SOAP DISPENSER SYSTEM

(71) Applicant: Bradley Fixtures Corporation, Menomonee Falls, WI (US)

(72) Inventors: Mark A. Meyer, Menomonee Falls, WI (US); Laura Stang, Mukwonago, WI (US); Michelle L. Rundberg, Jackson, WI (US); Mark A. Thielke, Menomonee Falls, WI (US)

(73) Assignee: Bradley Fixtures, LLC, Menomonee Falls, WI (US)

( * ) Notice: Subject to any disclaimer, the term of this patent is extended or adjusted under 35 U.S.C. 154(b) by 0 days.

(21) Appl. No.: 18/238,881

(22) Filed: Aug. 28, 2023

(65) Prior Publication Data

US 2023/0397778 A1 Dec. 14, 2023

Related U.S. Application Data

(63) Continuation of application No. 16/295,953, filed on Mar. 7, 2019, now abandoned.

(51) Int. Cl.
*A47K 5/12* (2006.01)

(52) U.S. Cl.
CPC ..... *A47K 5/1217* (2013.01)

(58) Field of Classification Search
CPC ..... A47K 5/1217
USPC ..... 222/39
See application file for complete search history.

(56) References Cited

U.S. PATENT DOCUMENTS 5,356,051 A * 10/1994 Azuma ..... A47K 5/14 222/401
5,555,912 A * 9/1996 Saadi ..... E03C 1/057 4/678
5,820,168 A * 10/1998 De Giacomoni ..... F16L 3/00 285/192
6,131,773 A * 10/2000 Wade ..... A47K 5/1215 222/153.09
2005/0135099 A1* 6/2005 Stuhlmacher, II .... F21V 33/004 362/253
2006/0152917 A1* 7/2006 Stuhlmacher, II .... F21V 33/004 362/109
2010/0005655 A1* 1/2010 Nguyen ..... B25B 33/00 29/280
2013/0075420 A1* 3/2013 Tramontina ..... A47K 5/1205 222/1
2014/0231450 A1* 8/2014 Rosko ..... A47K 5/1211 222/52
2014/0263421 A1* 9/2014 Urban ..... A47K 5/1211 222/173

(Continued)

*Primary Examiner* — Paul R Durand
*Assistant Examiner* — Michael J. Melaragno
(74) *Attorney, Agent, or Firm* — Boyle Fredrickson, S.C,

(57) ABSTRACT

A soap dispenser system includes a fixture disposed above a countertop and a soap container disposed below the countertop. The fixture includes a main body and a mount attached to the countertop. The main body includes a soap dispensing element that is fluidically coupled to the soap container via a fluid supply line. The mount includes an indication system and a refill port for accessing the soap container. The main body is removably coupled to the mount in order to expose the refill port and access the soap container. The indication system is configured to indicate a power status of the system and a soap level status of the soap container.

20 Claims, 10 Drawing Sheets

(56) References Cited

U.S. PATENT DOCUMENTS

| | | | | |
|---|---|---|---|---|
| 2015/0225932 | A1* | 8/2015 | Figurski | A47K 5/12 222/173 |
| 2015/0366411 | A1* | 12/2015 | Yang | A47K 5/1217 222/25 |
| 2016/0263604 | A1* | 9/2016 | Ramdhiansing | A47K 5/1211 |
| 2018/0103807 | A1* | 4/2018 | Burgo, Sr. | E03C 1/046 |
| 2019/0237506 | A1* | 8/2019 | Isaacson | H05B 33/10 |

* cited by examiner

SOAP DISPENSER SYSTEM

CROSS-REFERENCE TO RELATED APPLICATION

The present application is a continuation of U.S. Non-Provisional patent application Ser. No. 16/295,953, filed on Mar. 7, 2019. The entire contents of which are hereby expressly incorporated by reference into the present application.

BACKGROUND OF THE INVENTION

1. Field of the Invention

The present invention relates in general to a soap dispenser system. More particularly, the present invention relates to a soap dispenser system including visual and/or audible indication of operation and status of the soap dispenser system. Even more particularly, the present invention relates to a soap dispenser system including top-fill functionality of the soap container.

2. Discussion of the Related Art

Many washrooms include wash basins with separate water faucets and soap dispensers for each wash basin. The water faucet and soap dispenser extend out over the wash basin to allow a user to use both the water and soap without removing his hands from the wash basin and getting excess water and soap on the countertop. Each soap dispenser is fluidically connected to and dispenses soap from a soap container. As the soap dispenser is used over time, the soap container needs to be refilled by a maintenance worker. If the soap container is not refilled, the soap dispenser will no longer dispense soap once the soap container is empty. However, it is also inconvenient for a worker to check the soap level of each soap container each time they are in the washroom. Further, when a worker is refilling a soap container, there is a risk of overflow of the soap container. Overflow results in unnecessary excess waste and excess mess.

In addition, a pump assists in pulling soap from the soap container and pumping the soap out of the soap dispenser. A power supply, such as a battery, is required to operate the pump. If the power supply dies, the soap dispenser will no longer dispense soap. However, the worker has no way of knowing if a power supply has low power.

As such, there is a need in the art for a soap dispenser system with a visual and/or audible indication system that is seamlessly incorporated into a mounting base to notify a user of the operation and statuses of the elements of the soap dispenser system. For instance, high and low soap level in a soap container and power level of a power supply.

Current soap dispensers also require inefficient tubing connections or inefficient removal of pieces to refill the soap container, when the soap container is empty. That is, refilling the soap container can be a troublesome task for a worker. As such, there is also a need in the art for a soap dispenser system having a fixture that is easily removable from a mounted base, which is fluidically coupled to a soap container.

SUMMARY AND OBJECTS OF THE INVENTION

The present invention is directed to a soap dispensing system including a main body fixture that is removably coupled to a fixture mount. Additionally, the fixture mount includes an indication system for generating visual indication of status and operation of the soap dispensing system. Meanwhile, the soap dispensing system may also include an audible indication of status and operation of the soap dispensing system.

According to an embodiment of the invention, a soap dispenser system includes a fixture disposed above a countertop and a soap container disposed below the countertop. The fixture includes a main body and a mount attached to the countertop. The main body includes a soap dispensing element that is fluidically coupled to the soap container via a fluid supply line. The mount includes an indication system and a refill port for accessing the soap container. The main body is removably coupled to the mount in order to expose the refill port and access the soap container. The indication system is configured to indicate a power status of the system and a soap level status of the soap container.

In accordance with another aspect of the invention, the fluid supply line may be disposed within the fixture main body. The fluid supply line includes a first fluid connector disposed at an end of the fluid supply line and a second fluid connector extending from the fixture mount. The second fluid supply connector is configured to detachably couple with the first fluid connector. That is, when the fixture main body is removed from the fixture mount, the first and second fluid connectors detach from each other.

In accordance with yet another aspect of the invention, the indication system may include a translucent collar and an illumination device placed adjacent the translucent collar. Further, the soap container may include a low soap level sensor and a high soap level sensor. The illumination device is configured to provide a visual low soap level indication when the low soap level sensor detects a predetermined low soap level. For example, the low soap level may be 25% or lower of the volume of the soap container 18. The illumination device is also configured to provide a visual high soap level indication when the high soap level sensor detects a predetermined high soap level, for example, 75% or higher of the volume of the soap container 18. It is also contemplated that the indication system may include an audible device to provide an audible high soap level indication when the high soap level sensor detects the high soap level. Further yet, the indication system may also be configured to provide a visual low battery level indication when a power supply is at a low battery level.

According to another embodiment of the invention, a soap dispensing fixture includes a main body with a soap dispensing element and a mount secured to the countertop. The mount includes an indication system and a refill port fluidically coupled to a soap container. Further, the indication system is configured to provide a visual indication of a soap level and/or a battery level. The main body is removably coupled to the mount and configured to transition between an open orientation and a closed orientation.

In accordance with another aspect of the invention, the indication system includes an illumination device and a translucent collar affixed to the mount. The illumination device provides a visual indication of a low soap level and a visual indication of a high soap level. Additionally, the indication system may provide an audible warning of the high soap level.

In accordance with yet another aspect of the invention, the soap dispensing fixture may also include a locking mechanism configured to maintain the main body and the mount in the closed orientation. Further, the soap dispensing fixture may include a proximity sensor configured to detect whether the main body and the mount are in the closed orientation or the open orientation. In turn, the proximity sensor is configured to prevent activation of the soap dispensing element when the main body and the mount are in the open orientation.

In accordance with another aspect of the invention, the mount may include a plurality of supports extending upward from the mount and into the main body, when the main body and the mount are in the closed orientation. Further, the soap dispensing fixture may include a fluid supply line disposed within the main body. The fluid supply line includes a first fluid connector disposed at one end and a second fluid connector extending from the mount. The second fluid connector is configured to couple with the first fluid connector when the main body and the mount are in the closed orientation and detach from the first fluid connector when the main body and the mount are in the open orientation.

According to yet another embodiment of the invention, a soap dispenser system includes a fixture having a mount coupled to a countertop and a main body removably coupled to the mount. The mount includes a refill port and an indication system. The indication system includes a translucent collar placed adjacent a top surface of the countertop and an illumination device placed adjacent the translucent collar. Meanwhile, the main body includes a soap dispensing element. The mount and main body are configured to transition between an open orientation and a closed orientation. Further, a soap container may be fluidically coupled to the soap dispensing element via a supply line. The soap container may also be refillable via the refill port of the mount. In addition, the soap container may include a high-level soap sensor and a low-level soap sensor.

In accordance with another aspect of the invention, the indication system may provide a visual indication of a low soap level determined by the low soap level sensor and a high soap level determined by the high soap level sensor. The indication system may also provide an audible warning of the high soap level determined by the high soap level sensor.

In accordance with yet another aspect of the invention, a front surface of the collar may be flush with a front surface of the mount. Further, the fixture may include a locking mechanism with a locked position configured to maintain the main body and the mount in the closed orientation.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
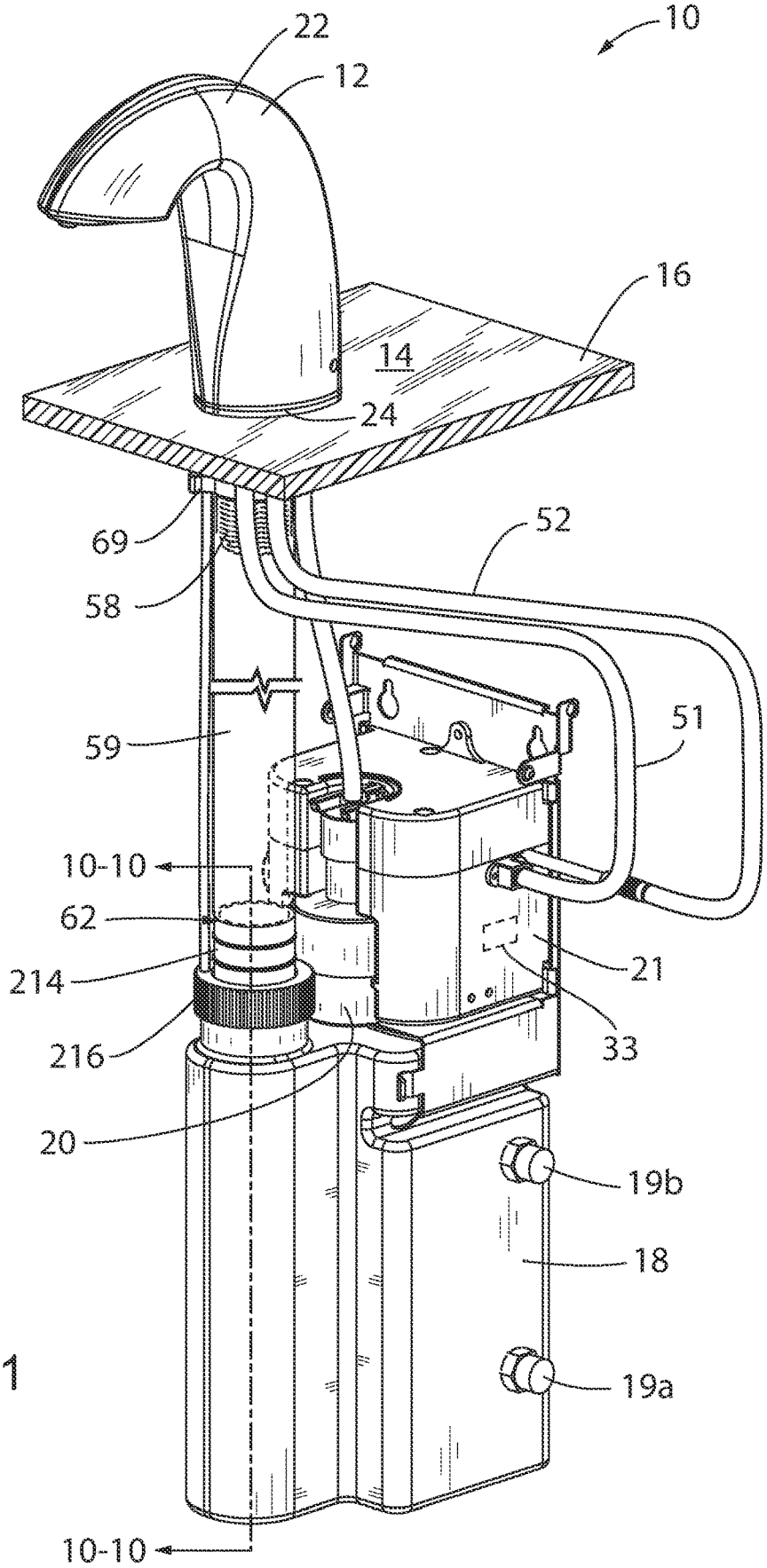
FIG. 1 is a perspective view of a soap dispenser system above and below a countertop according to an embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Throughout this description, various terms denoting direction, such as left and right, front and rear, up and down, top and bottom, and the like may be used. The directions are not intended to be limiting but are used to describe relationships of elements with respect to each other in the accompanying drawings. Unless mutually exclusive, it is contemplated that the elements may be reversed, for example, by turning a component around or upside down without deviating from the scope of the present invention.

Referring first to FIG. 1, a perspective view of a soap dispensing system 10 is shown. The soap dispensing system 10 includes a soap dispensing fixture 12 mounted to an upper surface 14 of a countertop 16. The soap dispensing system 10 also includes a soap container 18, pump 20, and control box 21 disposed below the countertop 16 so as to be hidden from the user. A battery (not shown) may be disposed below the countertop 16 and electrically connected to the control box 21, which operates the electrical components of the system 10. As further shown in FIGS. 1-4, the soap dispensing fixture 12 includes a main body 22 removably coupled to a fixture mount 24. The fixture mount 24 is mounted to the countertop 16.

The soap container 18 includes at least one soap sensor 19 to detect a fluid level within the soap container 18. In the representative embodiment of the invention, the container 18 includes a first soap sensor 19*a* and a second soap sensor 19*b*. The first soap sensor 19*a* is disposed within the soap container 18 at a location below the second soap sensor 19*b*. As such, the first soap sensor 19*a* is disposed within the soap container 18 at a location to determine when the soap level is below a predetermined low point. While the predetermined low point may be at any location, an example predetermined low point is 25% or lower of the volume of the soap container 18. In turn, the second soap sensor 19*b* is disposed within the soap container 18 at a location to determine when the soap level is above a predetermined high point. While the predetermined high point may be at any location, an example predetermined high point is 80% or higher of the volume of the soap container 18.

Figure 2:
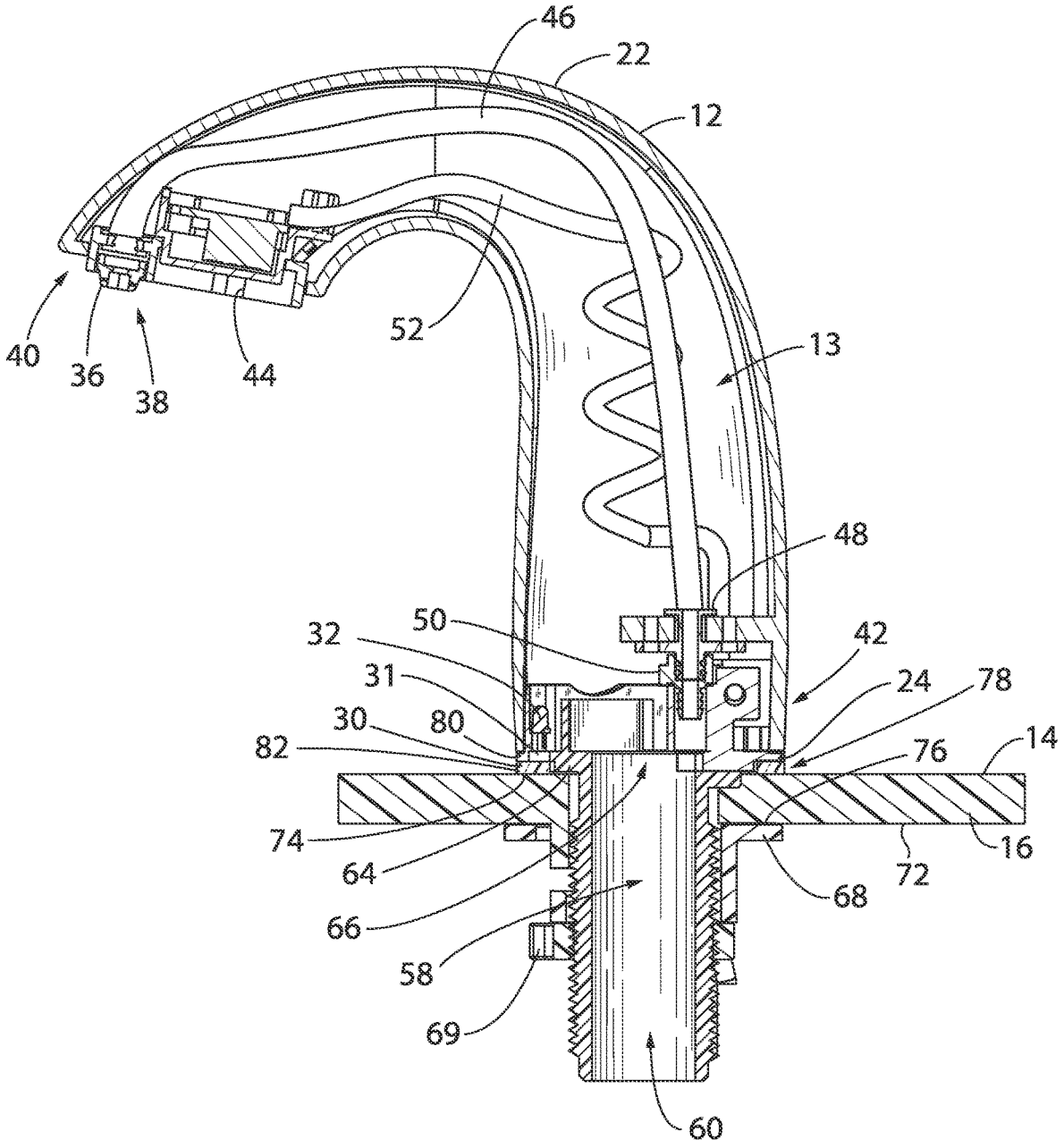
FIG. 2 is a cross-sectional view of the soap dispenser system of FIG. 1.

FIG. 2 is a cross-sectional view of the soap dispensing system 10 to further illustrate the elements disposed within a cavity 13 within the fixture 12. The fixture 12 includes a dispensing element 36 disposed at an outlet 38 thereof. The outlet 38 of the fixture 12 is located at a first end 40 of the main body 22, while a second end 42 of the main body 22 is in contact with the fixture mount 24. In the representative embodiment of the invention, the main body 22 of the fixture extends from the first end 40 to the second end 42 in an arced shaped. However, in other embodiments of the invention, the fixture main body 22 may extend from the first end 40 to the second end 42 in any shape. Further, a hand sensor 44 may be disposed within the outlet 38 of the fixture main body 22 and adjacent to the dispensing element 36.

A fluid supply line 46 extends from the dispensing element 36 at the first end 40 of the fixture 12 to a first fluid connector 48 at the second end 42 of the fixture 12. The fixture mount 24 of the fixture 12 includes a second fluid connector 50 extending upward therefrom. In FIG. 2, the first and second fluid connectors 48, 50 are shown as detachably connected to each other. The benefits of the detachable connection between the first and second fluid connectors 48, 50 will be described in further detail below.

The wiring 52 may be tethered from the control box 21 underneath the countertop 16 to the hand sensor 44 and dispensing element 36 at the first end 40 of the fixture 12. It is contemplated that the fixture mount 24 of the fixture 12 may include a wire guide 56 formed therein and having an opening therethrough to allow the wiring 52 to extend through the fixture mount 24 and into the opening 13 of the fixture main body 22. As shown in FIG. 2, the wiring 52 may be coiled in order to allow the wiring 52 to move as necessary and without exerting any forces on the on the control box 21, the sensor 44, or the dispensing element 36 when the main body 22 of the fixture 12 is displaced from the fixture mount 24 of the fixture 12. Additionally, the coiling of the wiring 52 assists in fitting the wiring 52 within the main body 22 without unnecessary duress by the user or maintenance workers.

In an alternative embodiment of the invention, the wiring 52 may be configured to detachably connect, similar to the fluid supply line 46 described above. In such an embodiment, the wiring 52 may extend from the first end 40 of the fixture to a first wire connector at the second end 42 of the fixture 12. The fixture mount 24 of the fixture 12 may then include a second wire connector disposed at guide 56 and extending upward from the fixture mount 24. In turn, the first and second wire connectors may be detachably connected to each other in order to detach when the main body 22 is displaced from the fixture mount 24.

As shown in FIG. 2, the fixture mount 24 of the fixture 12 includes a refill port 58 extending from above the countertop 16 to below the countertop 16. A lower portion 60 of the refill port 58 may be threaded to engage with a refill hose 59 extending between the refill port 58 and an opening 62 of the soap container 18 (see e.g., FIG. 1). It is contemplated that the refill hose 59 may be made from a flexible material that allows the hose 59 to be manipulated during installation, as necessary. An upper mount 64 extends laterally from an upper end 66 of the refill port 58 to engage the upper surface 14 of the countertop 16. Meanwhile, a lower mount 68 slidably engages the refill port 58. In the representative embodiment of the invention, the lower mount 68 surrounds the lower portion 60 of the refill port 58 and rotated until it contacts a lower surface 72 of the countertop 16 so as to engage the lower surface 72 of the countertop 16. In the representative embodiment of the invention, a lower surface 74 of the upper mount 64 is spaced apart from an upper surface 76 of the lower mount 68 by a distance equal to or approximately equal to the thickness of the countertop 16. As a result, the countertop 16 is sandwiched between the upper and lower mounts 64, 68. In turn, a mounting nut 69 is further secured to the lower portion 60 of the refill port 58. As shown in FIG. 2, the mounting nut 69 and the lower portion 60 of the refill port 58 are both configured to threadably engage with each other to secure the mounting nut 69 to the refill port 58. As such, the mounting nut 69 assists in securing the lower mount 68 in place.

The fixture mount 24 of the fixture 12 further includes a collar 30 disposed adjacent the countertop 16. In turn, an illumination device 32, such as, but not limited to LED, may be disposed adjacent the collar 30 in order to illuminate the collar 30 and provide a visual indication of the status or operation of the soap dispensing system 10. As such, the collar 30 and the illumination device 32 combine to create an indication system 31. While the representative embodiment of the invention depicts the illumination device 32 as being located above the collar 30 and at the front of the fixture mount 24, it is contemplated that other embodiments of the invention may locate the illumination device 32 above, below, or in-line with the collar 30 and at any location around the fixture mount 24 including, but not limited to, the front, sides, and rear of the fixture mount 24. The collar 30 is preferably a translucent material that allows the illumination device 32 to illuminate the collar 30. For example, the collar 30 may be a translucent silicone. The operation of the LED 32 will be further described below. Additionally, the LED 32 may be electrically coupled to the control box 21 by way of wiring 51.

As shown in FIG. 2, the upper mount 64 may include a recess or notch 78 formed in an outer surface 80 thereof. The recess 78 is formed to receive the collar 30, so that the depth of the recess 78 is equal to the width of the collar 30. As a result, an outer surface 82 of the collar 30 is aligned with the outer surface 80 of the upper mount 64 to form a flush transition between the respective outer surfaces 80, 82. The collar 30 is sandwiched between the upper mount 64 and the upper surface 14 of the countertop 16.

FIG. 1 further depicts the pump 20 fluidically coupled to the soap container 18. In turn, the pump 20 is fluidically coupled to the second fluid connector 50. As a result, the pump 20 transfers soap from the soap container 18 to the supply line 46, which are connected to each other via the first and second fluid connectors 48, 50. The supply line 46 then transfers the soap from the first fluid connectors 48 to the dispensing element 36. Upon activation of the hand sensor 44, the dispensing element 36 dispenses the soap into a user's hands.

Figure 3:
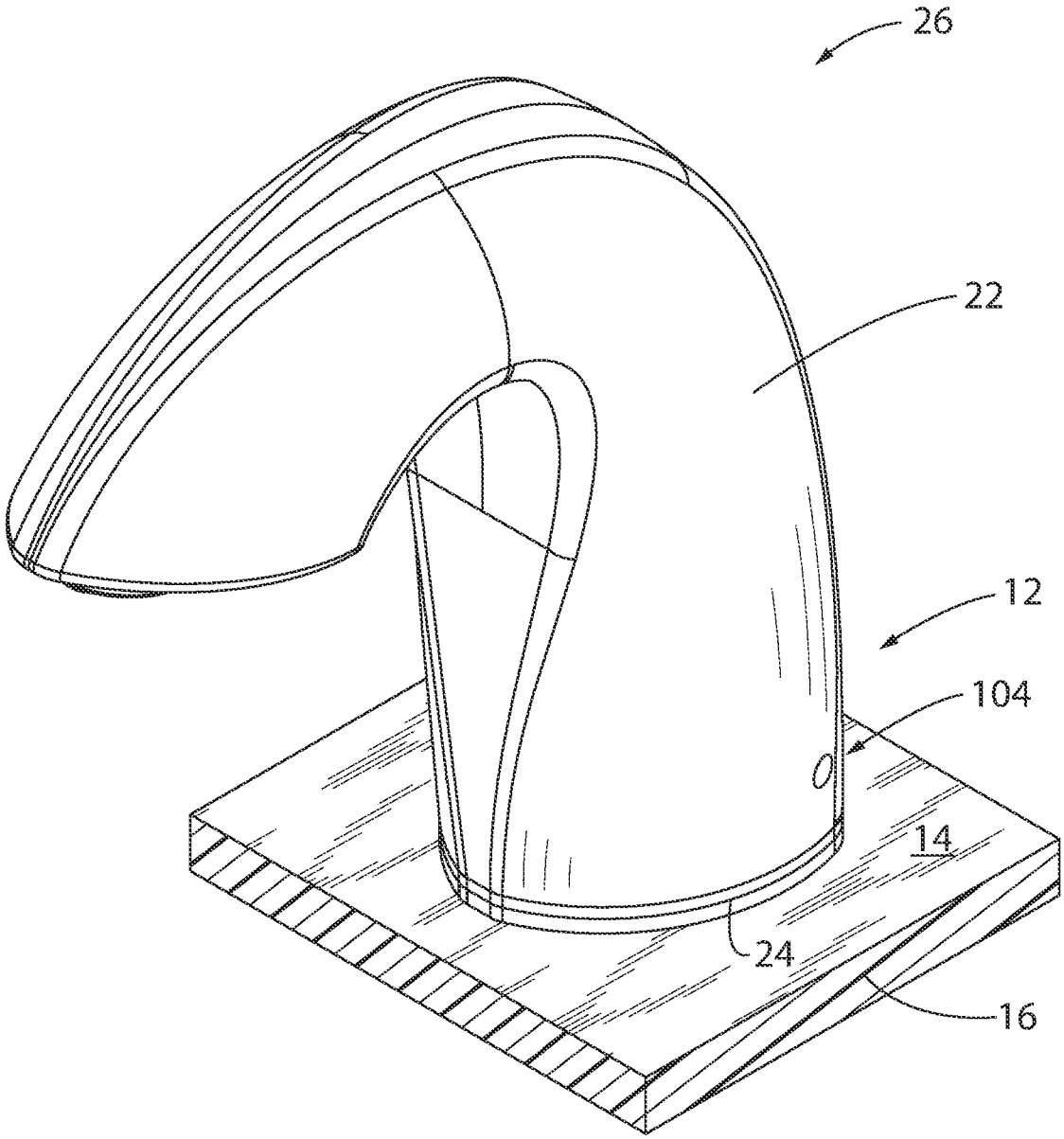
FIG. 3 is a perspective view of a soap dispensing fixture of the soap dispenser system of FIG. 1 in a closed orientation.

FIG. 3 illustrates the soap dispensing fixture 12 in a closed orientation 26. In the closed orientation 26, the main body 22 of the fixture 12 is coupled to the fixture mount 24 of the fixture 12. In the closed orientation 26, the first and second fluid connectors 48, 50 are coupled together to allow fluid to flow from the pump 20, through the supply line 46, and to the dispenser 36.

Figure 4:
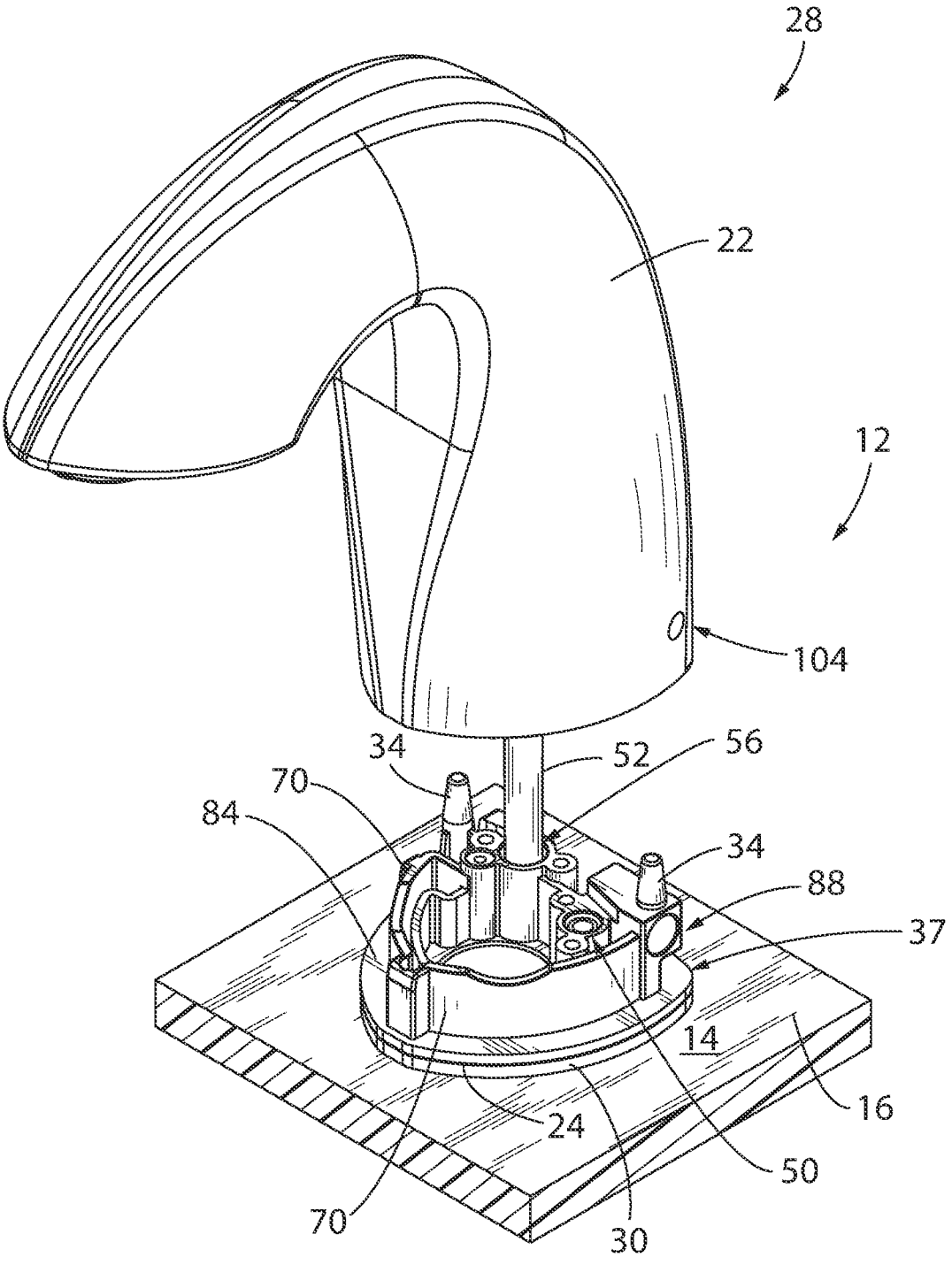
FIG. 4 is a perspective view of the soap dispensing fixture of FIG. 3 in an open orientation.

Meanwhile, FIG. 4 illustrates the soap dispensing fixture 12 in an open orientation 28. In the open orientation 28, the main body 22 of the fixture 12 is decoupled from the fixture mount 24 of the fixture 12. Additionally, the first and second fluid connectors 48, 50 are decoupled from each other to fluidically decouple the supply line 46 and the pump 20. As a result, the fixture 12 is unable to dispense fluid while in the open orientation 28. In addition, the fixture 12 may include a proximity sensor configured to detect whether the main body 22 and the fixture mount 24 are in the open orientation 28 or the closed orientation 26. The proximity sensor may be disposed within the main body 22 and electrically coupled to the sensor 44 and/or dispensing element 36. As such the proximity sensor may prevent activation of the dispensing element 36 when it detects that the main body 22 and the fixture mount 24 are in the open orientation 28. An exemplary configuration of the proximity sensor may be seen in FIGS. 8 and 9, in which the proximity sensor 154 is shown and will be later described in fuller detail.

FIG. 4 also provides a further representative embodiment of the fixture mount 24. As shown, the fixture mount 24 includes a plurality of supports 34 extending upward from a top surface 84 of the upper mount 64 of the fixture mount 24. The supports 34 may be in the form of tapered pins disposed on opposite sides of a rear end 37 of the fixture mount 24. However, it is also contemplated that the supports 34 may be in the form of other shapes. The supports 34 are also configured to prevent movement and provide structural support for the fixture 12 when in the closed orientation 26 by extending upward and into the cavity 13 of the fixture 12. While FIG. 4 illustrates the use of two (2) supports 34 disposed at the rear of the fixture mount 24, it is contemplated that varying embodiments of the invention may include more or less than two (2) supports 34 extending upward from the fixture mount 24 at a variety of locations surrounding the refill port 58. Additionally, the fixture mount 24 may include at least one additional support wall extending upward from the top surface 84 of the fixture mount 24 at locations between the supports 34 and surrounding or at least partially surrounding the refill port 58. In turn, the additional support walls 70 extend into the cavity 13 of the fixture 12 and provide additional structural support.

Additionally, the support walls 70 may be used to guide the main body 22 it is transferred between the open orientation 28 and the closed orientation 26. As shown in FIG. 2, an outer surface 71 of the support walls 70 is configured to be directly adjacent an inner surface 23 of the main body 22. As a result, the support walls 70 are able to guide movement of the main body 22 and the fixture mount 24 without providing friction between the components. This concept is further illustrated in FIG. 6, which illustrates the close arrangement of the support walls 70 and the main body 22. That is, the close arrangement of the support walls 70 that result in the above guidance of the main body 22 and the mount 24 may take place at one or more locations A, B, and C.

In addition, while FIG. 4 illustrates the second fluid connector 50 and wire guide 56 as being disposed at rear locations of the fixture mount 24, it is contemplated that the second fluid connector 50 and the wire guide 56 may be located at any locations on the fixture mount 24 surrounding the refill port 58. Additionally, the second fluid connector 50 may extend upward from the top surface 84 of the fixture mount 24 a distance equal to the height of the support wall as shown in FIG. 4, or a distance more or less than the height of the support wall 70. Similarly, the wire guide 56 may extend upward from the top surface 84 of the fixture mount 24 a distance greater than the height of the support wall 70, as shown in FIG. 4, or a distance equal to or less than the height of the support wall 70. For example, at least one of the second fluid connector 50 and wire guide 56 may be flush with a top surface 84 of the fixture mount 24.

Figure 5:
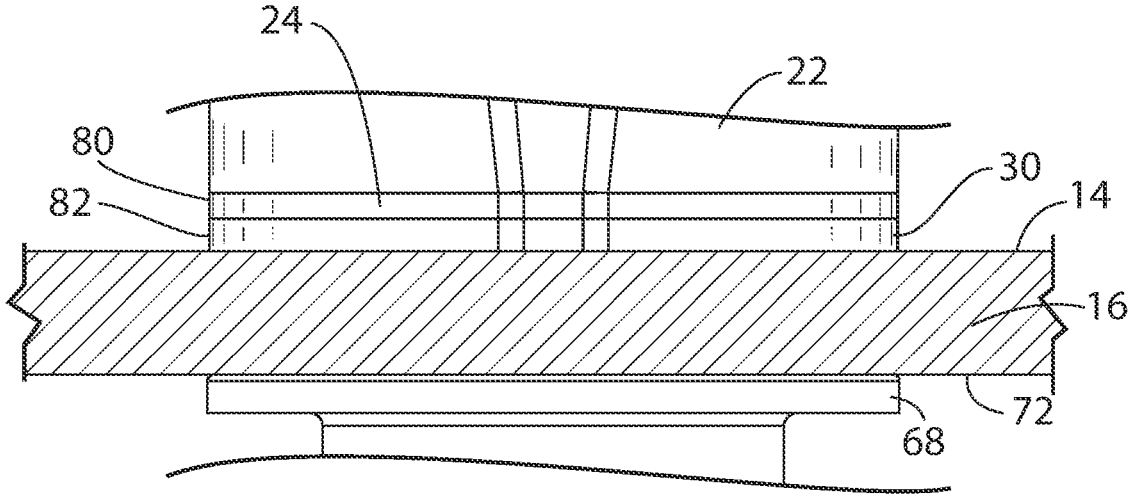
FIG. 5 is an enlarged front view of a collar of the soap dispensing fixture of FIG. 3.

Next, FIG. 5 illustrates an enlarged front view of the fixture mount 24 and, more specifically, the collar 30. As shown, the fixture mount 24 includes an upper mount 64 disposed above the countertop 16 and a lower mount 68 disposed below the countertop 16. In turn, the upper mount 64 and the lower mount 68 are each sized larger than the orifice 17 in the countertop 16 (see FIG. 2), to sandwich the countertop 16 between the upper mount 64 and the lower mount 68. Further, the collar 30 is disposed within the previously described recess 78 formed in the outer surface 80 of the upper mount 64. As such, the collar 30 is disposed between the upper mount 64 of the fixture mount 24 and the countertop 16. As previously discussed, the collar 30 is sized to fit within the recess so that the outer surface 80 of the fixture mount 24 is flush with the outer surface 82 of the collar 30. In other embodiments of the invention, the collar 30 may be sized so that its outer surface 82 extends beyond are is spaced inward from the outer surface 80 of the fixture mount 24.

Figure 6:
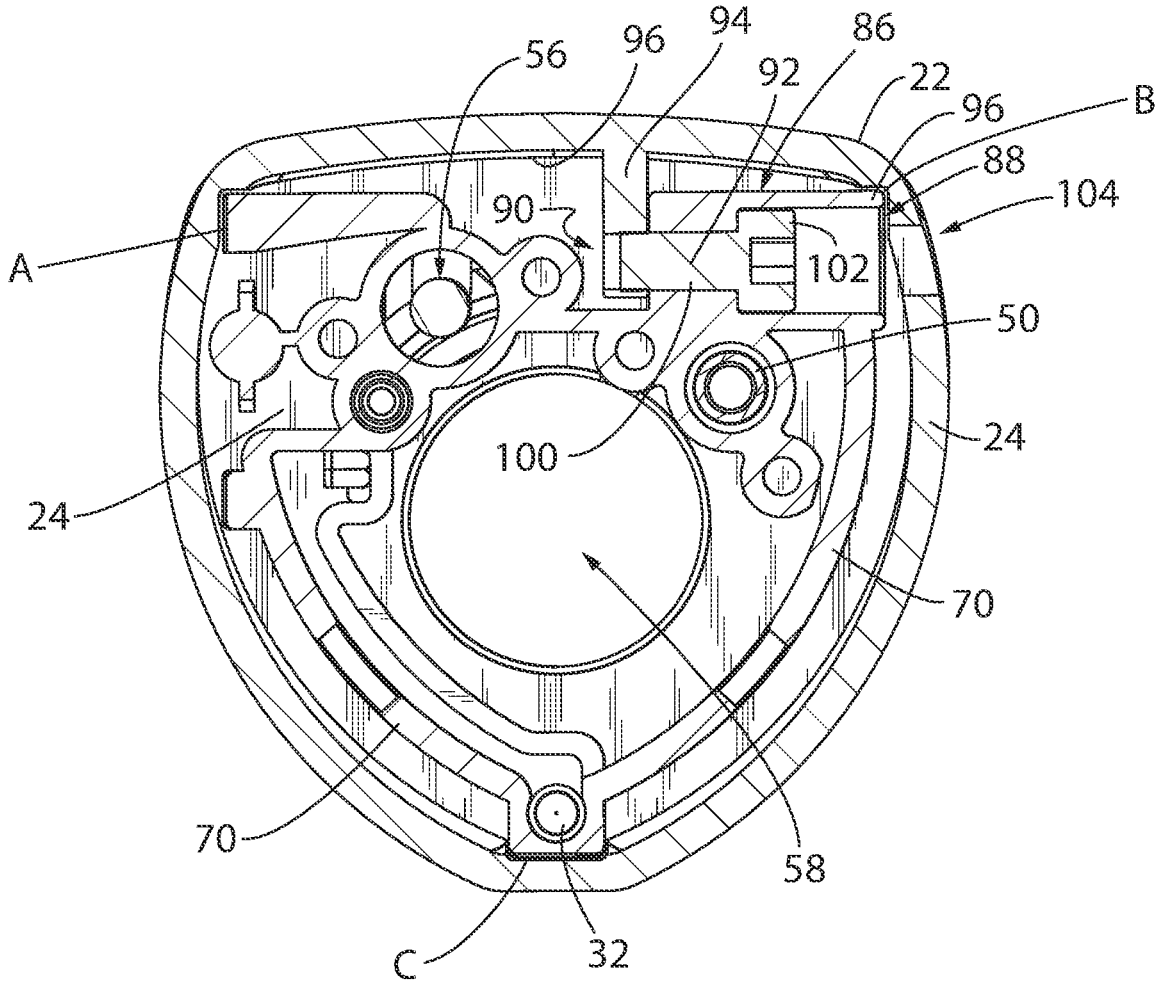
FIG. 6 is a cross-sectional view of a mount of the soap dispensing fixture of FIG. 3.

Now referring to FIG. 6, a top cross-sectional view of the main body 22 and the fixture mount 24 of the fixture 12 shown in FIG. 3. As shown, the fixture 12 includes a locking mechanism 86 to maintain the fixture 12 in the closed orientation 26 of FIG. 2. In the representative embodiment of the invention, the locking mechanism 86 includes an orifice 88 formed in the fixture mount 24 aligned with an orifice 90 formed in the fixture main body 22. In turn, a locking screw or pin 92 may be inserted into both orifices 88, 90 to prevent the fixture main body 22 from being removed from the fixture mount 24. As shown in FIG. 6, the orifice 90 of the fixture main body 22 may be formed in a tab 94 extending into the cavity 13 of the fixture 12 from an inner surface 96 of the main body 22. Meanwhile, the orifice 88 of the fixture mount 24 may be formed in a raised portion 96 extending upward from the upper surface 84 of the fixture mount 24.

As stated above, the orifices 88, 90 are configured to align with each other when the fixture 12 is in the closed orientation 26. The locking screw 92 is able to transition between a locked position 98, as shown in FIG. 6, and an unlocked position (not shown). The locking screw 92 may include a shaft 100 and a screw head 102, wherein the shaft 100 and screw head 102 are maintained within the orifice 88 of the fixture mount 24 in both the locked position 98 and the unlocked position, but the shaft 100 of the locking screw 92 is configured to be positioned within the orifice 90 of the main body 22 when in the locked position 98. That is, when in the locked position, the locking screw 92 is positioned within both orifices 88, 90. Additionally, another orifice 104 may be formed through the main body 22 of the fixture and further aligned with the orifice 88. Orifice 104 is configured to allow a tool to extend through the main body 22 and into the orifice 88 of the fixture mount 24. In turn, the tool may interact with the screw head 102 and allow a user to transition the locking screw 92 between the locked position 98 and the unlocked position.

In the representative embodiment of the invention, the orifice 104 in the main body 22 may be sized to have a diameter smaller than that of the screw head 102. As a result, the screw head 102 is unable to traverse through the orifice 104, which prevents a user or maintenance worker from losing the locking screw 92, while the fixture 12 is in the closed orientation 26.

It is contemplated that the LED 32 of the collar may illuminate differently for different statuses and operations of the system 10. For example, the LED 32 may illuminate by flashing green, red, or any other color when the system 10 is turned on. The LED 32 may flash any number of times or for any predetermined period of time. In one particular embodiment, the LED may flash green three (3) times. In yet other embodiments of the invention, the LED 32 may illuminate steadily for any number of seconds.

In another example, the LED 32 may illuminate to indicate a low soap level in response to the low soap sensor 19*a* being triggered. For example, the low soap level sensor 19*a* may be disposed within the soap container 18 to be triggered when the soap level of the container is at or below a designated low soap level, such as 20%, 25%, or the like of the volume of the soap container 18. In other embodiments of the invention, the designated low soap level may be above or below 20% of the volume of the soap container 18. The LED 32 may illuminate by flashing red or any other color until the low soap sensor 19*a* indicates that the soap has been filled past the designated low soap level. The LED 32 may cycle between on and off for any number of seconds. In one example, the LED 32 may flash by cycling between on for 0.2 seconds and off for 2 seconds. However, this is not a limiting example. In other embodiments of the invention, the LED 32 may illuminate steadily for any number of seconds. It should also be noted that the system 10 is still able to dispense soap while the LED 32 indicate a low soap level.

The LED 32 may also illuminate to indicate a high soap level in response to the high soap level sensor 19*b* being triggered. The high soap level sensor 19*b* may be disposed within the soap container 18 to be triggered when the soap level of the container is at or above a designated high soap level, such as, but not limited to, 75%, 80%, or the like of the volume of the soap container 18. In other embodiments of the invention, the designated low soap level may be above or below 80% of the volume of the soap container 18. The LED 32 may illuminate one or more of any color steadily for any number of seconds. For example, the LED 32 may illuminate red for 2.5 seconds. In other embodiments of the invention, the LED 32 may illuminate another color, such as, but not limited to, green, for any amount of time. It is also contemplated that the indication system 31 may include an audible notification device 33 disposed away from the mount 24 and within the control box 21 and configured to generate an audible warning. For example, the audible warning may be at a volume of 80 decibels. The volume of the audible warning may also be set louder or quieter than 80 decibels. Additionally, the audible warning may be in conjunction with the visual indication provided by the LED 32 and last for the same amount of time as the visual indication provided by the LED 32. However, it is also contemplated that the audible warning may last longer or shorter than the visual indication. It is also contemplated that the audible notification device 33 may be disposed in any location, not just within the control box 21. Once the fixture 12 is returned to the closed orientation 26 after filling, the system 10 will then be able to dispense soap.

In another example, the LED 32 may illuminate by flashing green, red, or any other color when the power source, such as the previously discussed battery, is determined to have low power, for example, but not limited to, less than 5 volts. When the low and high soap level sensors 19*a*, 19*b* are triggered and the LED 32 illuminate accordingly, the power level of the power source is detected until the LED 32 turn off. In the representative embodiment of the invention, the LED indications for soap levels are prioritized over the LED indication for low power. To indicate that the power source has low power, the LED 32 may cycle between on and off for any number of seconds. In a particular embodiment of the invention, the LED 32 may flash by cycling between on for 0.2 seconds and off for 2 seconds. Further, the LED 32 may use a number of colors when on. For example, the LED 32 may switch between red and green for the 0.2 seconds. That is, the LED 32 may be red for 0.1 seconds, green for 0.1 seconds, and then turn off for 2 seconds. It is further contemplated that the LED 32 may remain operational for low power indication until the power source is detected to reach a certain minimum, for example, but not limited to, 3 volts or more. At this point, the power level detection and the soap level detection may be deactivated in order to save power.

The LED 32 may also be used to indicate usage of the system 10. For instance, the LED 32 may flash green, red, or any other color while the soap dispensing element 36 discharges soap to the user's hands. In some embodiments of the system, the LED 32 may indicate usage every time that the sensor 44 detects a user's hands and the soap dispensing element 36 discharges soap. In other embodiments of the invention, the usage indication may be limited to activation of the soap dispensing element 36 during priming of the system, in which air is removed from the supply line 46.

Figure 7:
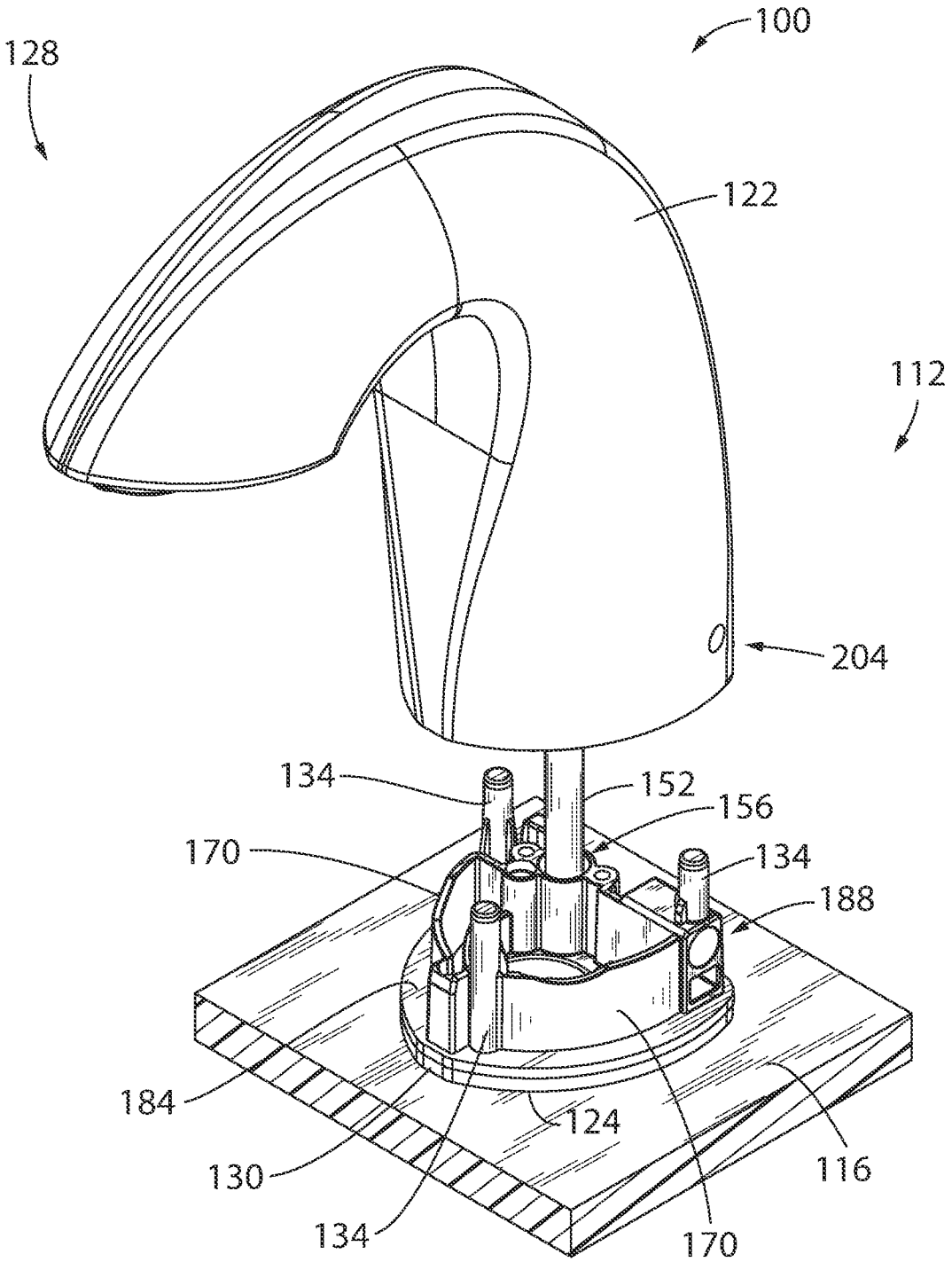
FIG. 7 is a perspective view of a soap dispensing fixture, according to another embodiment of the present invention, in an open orientation.

FIG. 7 depicts a soap dispensing fixture 112 of a soap dispensing system 110 in an open orientation 128, according to another embodiment of the invention. The soap dispensing fixture 112 includes a main body 122 and a fixture mount 124 coupled to the countertop 116. Similar to the open orientation 28 described in FIG. 4 above, the open orientation 128 of FIG. 7 shows the main body 122 of the fixture 112 as decoupled from the fixture mount 124 of the fixture 112. Similar to the previously discussed fixture 12, the fixture 112 includes a first fluid connector at a distal end of the supply line and a second fluid connector 150 disposed within the fixture mount 124. The first and second fluid connectors 150 are configured to decouple from each other when the fixture 112 is moved from the closed orientation to the open orientation 128. In turn, the supply line is fluidically decoupled from the pump, when the fixture 112 is in the open orientation 128.

Figure 8:
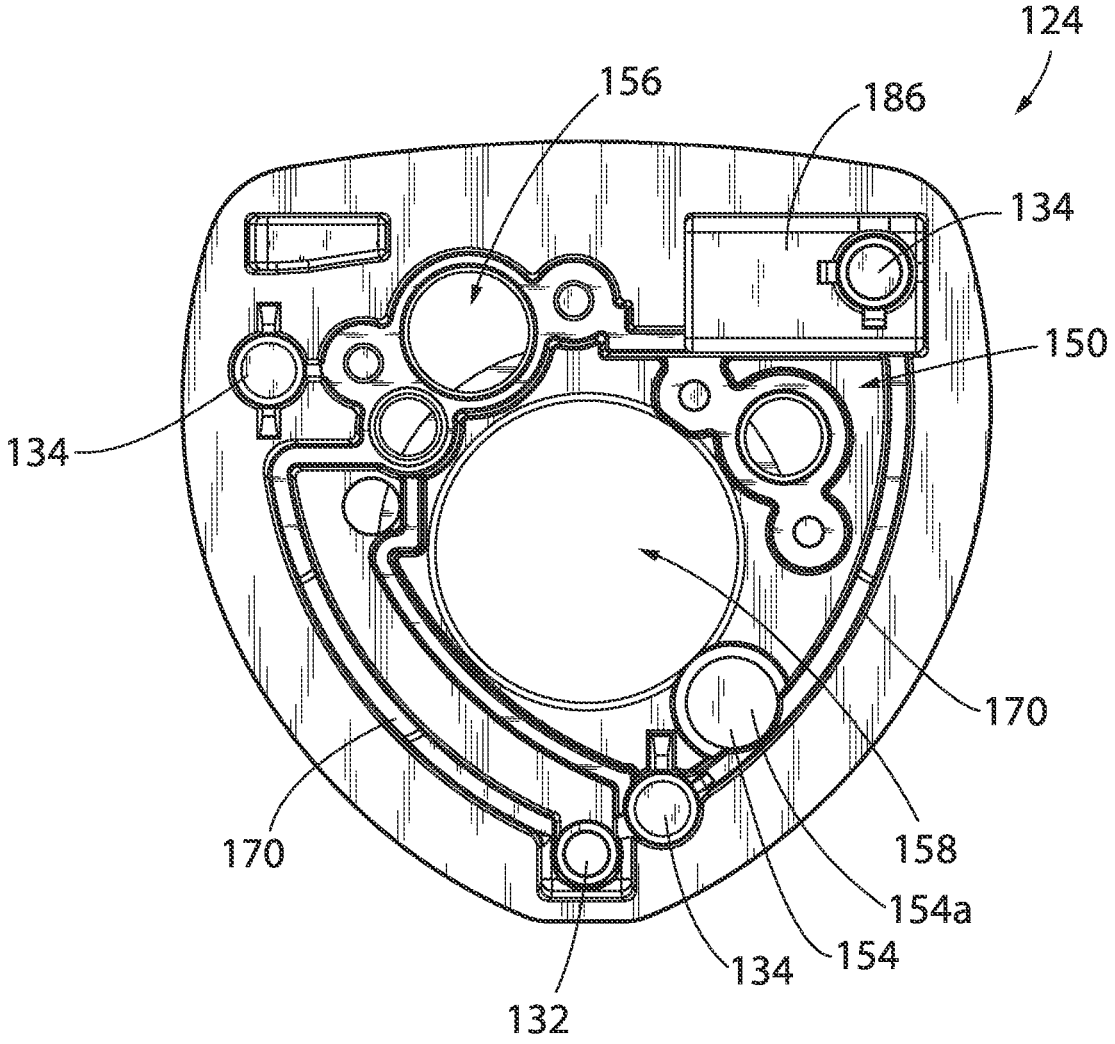
FIG. 8 is a top view of a mount of the soap dispensing fixture of FIG. 7.

As shown in FIGS. 7 and 8, the fixture mount 124 of the fixture 112 includes three (3) supports 134 extending upward from a top surface 184 of the fixture mount 124. In other embodiments of the invention, the fixture mount 124 may include more or less than three (3) supports 134. In addition, while the representative embodiment of the invention illustrates the supports 134 as tapered pins, the supports 134 may be configured in the form of any shape. The fixture mount 124 also includes a number of walls 170 extending upward from the top surface 184 of the fixture mount 124 and surrounding, either fully or partially, a refill port 58 fluidically coupled to the soap container. The supports 134 and walls 170 act to provide additional structural support for the fixture 112 when in the closed orientation by extending into a cavity of the main body 122.

While the fluid connector 150 and the wire guide 156 of the fixture mount 124 are shown located at rear locations of the fixture mount 124, the fluid connector 150 and wire guide 156 may be located at any location on the fixture mount 124 surrounding the refill port 158. As shown in FIG. 7, the fluid connector 150 extends upward from the top surface 184 of the fixture mount 124 a distance less than the height of the adjacent support wall 170. In other embodiments of the invention, the fluid connector 150 may extend upward from the top surface 184 a equal to or more than the height of the adjacent support wall 170. Similarly, while the wire guide 156 is shown as extending upward from the top surface 184 of the fixture mount 124 a distance equal to the height of the adjacent support wall 170, it is also contemplated that the wire guide 156 may extend upward from the top surface 184 at distance more or less than the height of the adjacent support wall 170. The fixture mount 124 shown in FIG. 7 also includes a collar 130, similar to the previously discussed collar 30 of fixture mount 24.

FIG. 8 further shows the fixture mount 124 including a locking mechanism 186 that assist in securing the fixture 112 in the closed orientation. The locking mechanism 186 is formed similar to the previously described locking mechanism 86. FIG. 7 depicts the orifice 188 formed in the fixture mount 124 that is aligned with an orifice 204 formed in the main body 22 of the fixture 112. In the closed orientation, the orifices 188, 204 are configured to align with each other, so that a tool may be inserted through the orifice 204 in the main body and interact with the locking screw disposed within the orifice 188. As discussed above, the locking screw of the locking mechanism may be oriented in a locked or unlocked position. In the locked position, the fixture 112 is maintained in the closed orientation. In the unlocked position, the user may transition the fixture 112 to the open orientation.

Figure 9:
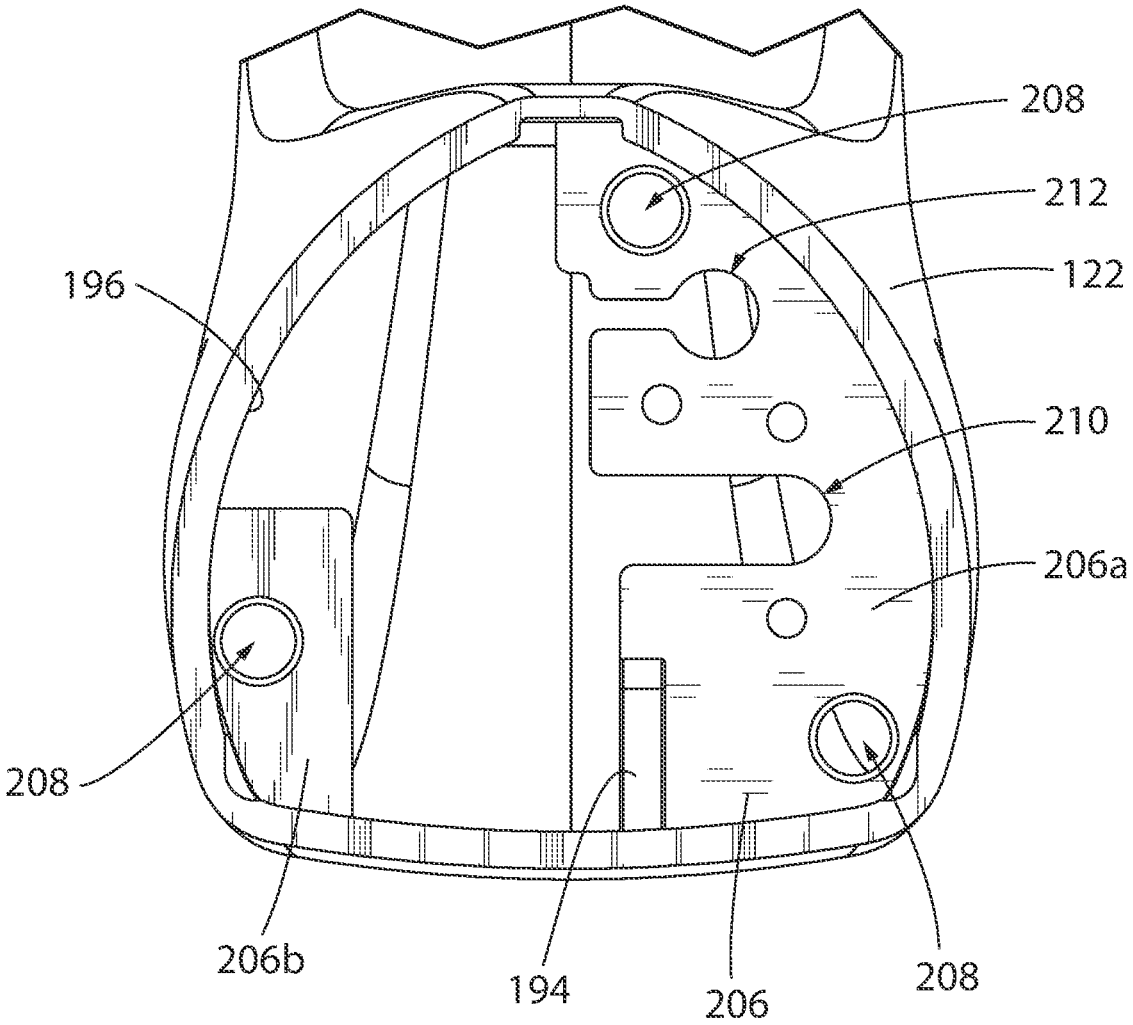
FIG. 9 is a bottom view of a detached body of the soap dispensing fixture of FIG. 7.

Now referring to FIG. 9, a bottom view of the main body 122 is shown and depicts the interior elements of the main body 122 at the second end 142 of the main body 122. As shown, the main body 122 includes at least one support plate 206 extending inward from the inner surface 196 of the main body 122. In the representative embodiment of the invention, the support plate 206 is distinguishable into a first support plate 206*a* and a second support plate 206*b*, both oriented horizontally within the main body 122. In other embodiments of the invention, the support plate 206 may be separated into any number of support plates 206*n*, resulting in any amount of open space between the support plates 206*n*.

The support plate 206 includes a number of orifices 208 corresponding to the number of supports 134 in the mount 124. The orifices 208 are positioned so that they are aligned with the supports 134 when the main body 122 is aligned with the mount 124. In turn, when the main body 122 and mount 124 are in the closed orientation 126, a portion of each support 134 extends through a respective orifice 208. For example, the support plate 206 of the representative embodiment of the invention includes three (3) orifices 208 corresponding to the three (3) supports 134 in the mount shown in FIGS. 7 and 8. In other embodiments of the invention, such as that shown in FIG. 4, the support plate would include two (2) orifices aligned with the two (2) supports 34. Yet other embodiments of the invention may include any number of orifices and supports. The support plate 206 further includes a connector slot 210. The connector slot 210 is configured to receive the previously discussed first connector of the fluid supply line. That is, the connector slot 210 maintains the position of the first fluid connector within the main body 122. It is contemplated that the first fluid connector may disposed within the slot 210 and attached to the support plate 206 by any combination of fasteners, friction fit, or other mechanical fastening methods.

As discussed above, the fixture 112 may include a proximity sensor 154 configured to detect whether the main body and the mount are in the closed orientation or the open orientation. While a variety of proximity sensor types are contemplated by the present invention, the representative embodiment of the invention depicts a proximity sensor 154 separated into a first element 154*a* disposed in the mount 124 and a second element 154*b* disposed within the main body 122. As shown in FIG. 9, the support plate 206 has a proximity sensor slot 212 formed therein and configured to hold the second element of the proximity sensor 154 in a consistent position within the main body 122. The second element of the proximity sensor 154 may be disposed within the slot 212 and attached to the support plate 206 via at least one of a fastener, friction fit, or other known mechanical fastening method. When the fixture 112 is in the closed orientation, the first and second elements of the proximity sensor 154 are placed adjacent each other. In turn, the proximity sensor 154 is configured to detect that the first and second elements are adjacent each other and determine that the fixture 112 is in the closed orientation. Conversely, when the fixture 112 is in the open orientation, the elements of the proximity sensor 154 are spaced apart from each other. In turn, the proximity sensor 154 is able to detect that the first and second elements are not adjacent each other and determine that the fixture 112 is in the open orientation.

Figure 10A:
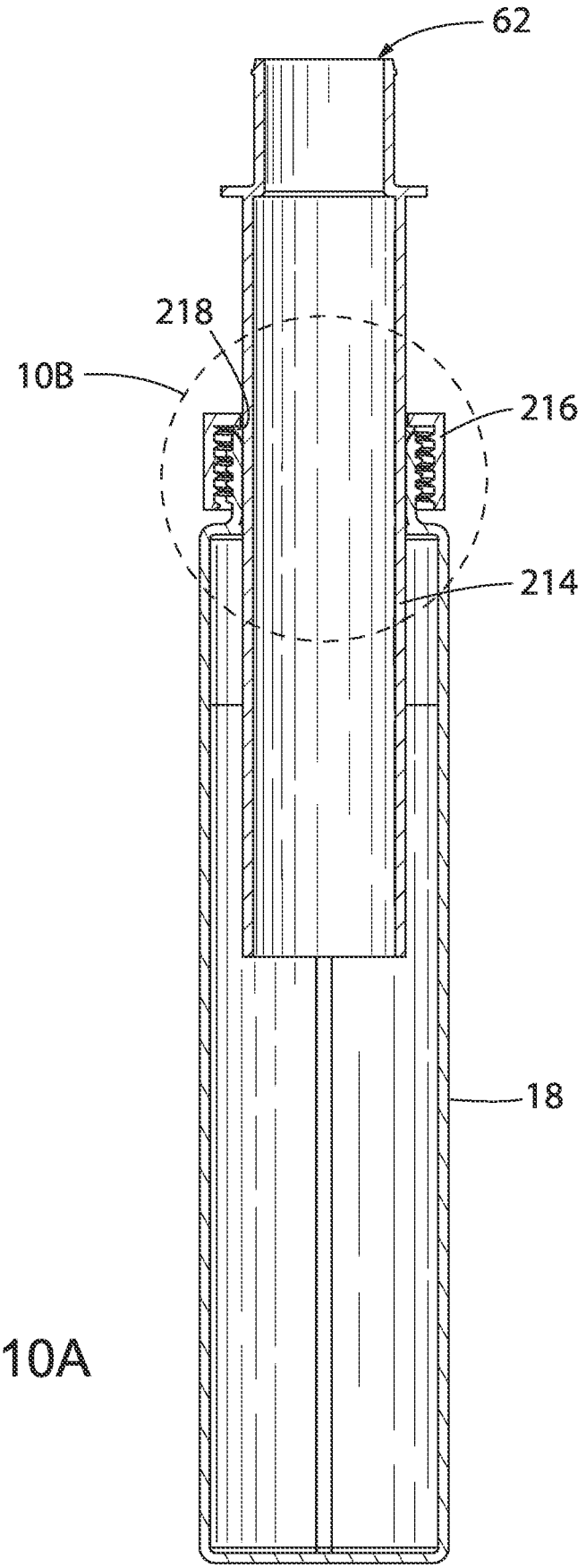
FIG. 10A is a cross-sectional view of the soap container of FIG. 1, taken along line 10-10.
Figure 10B:
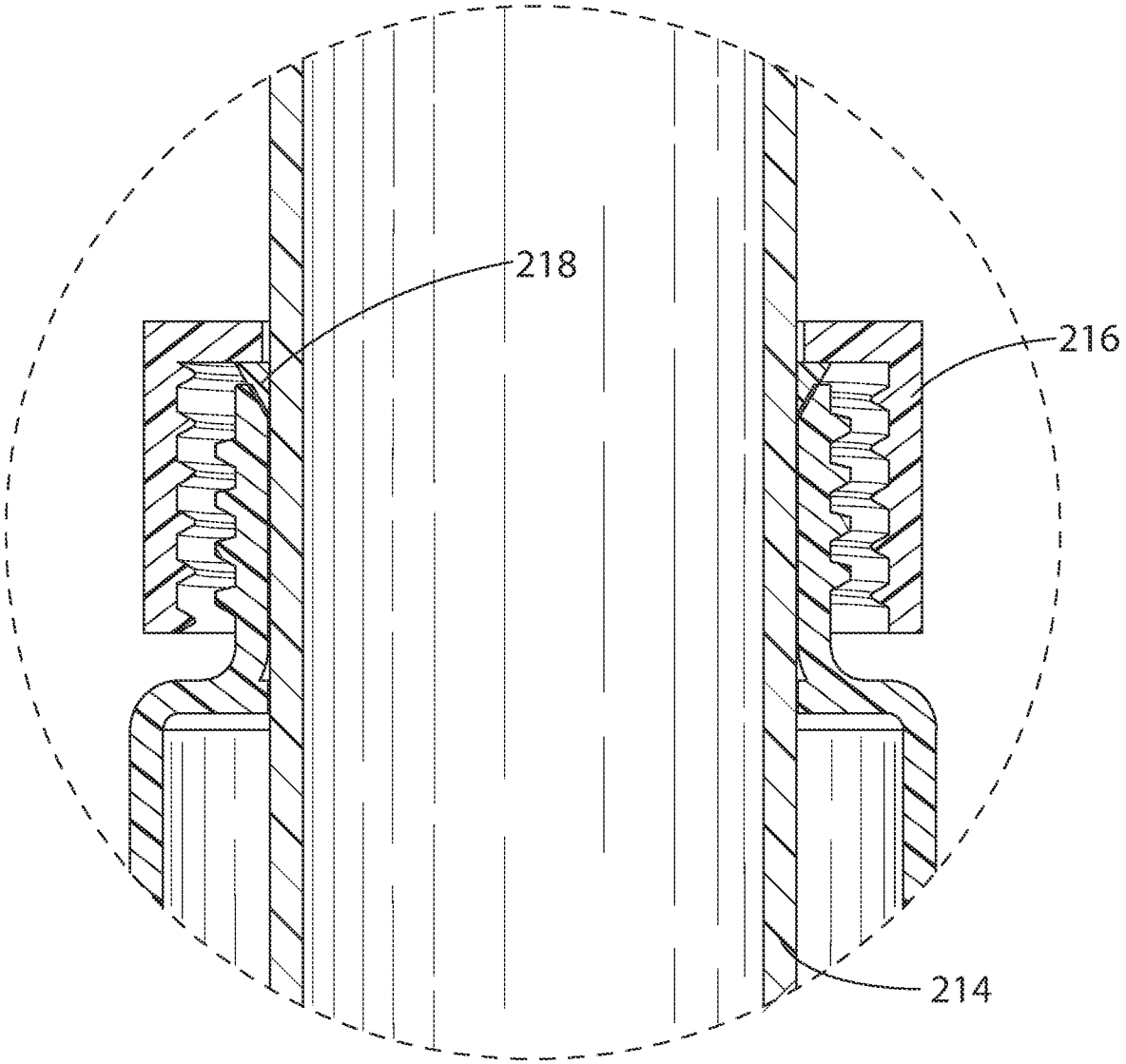
FIG. 10B is an enlarged view of portion 10B of FIG. 10A.

Finally, FIGS. 10A and 10B illustrates a cross-sectional view of the soap container 18 of FIG. 1. The previously described soap container 18 includes an opening 62 that is fluidically coupled to the refill port 58 by way of a refill hose 59. In varying embodiments of the invention, the opening 62 of the soap container 18 may be vertically adjusted to shorten the distance between the opening 62 and the refill port 58. As a result, the system 10 may be customized to fit under any countertop. As shown in FIG. 10, the opening 62 of the soap container 18 includes an extension tube 214, a locking nut 216, and a compression ring 218 that work in conjunction with each other to create a slip fit engagement. When the locking nut 216 is loosened, the extension tube 214 is able to adjust vertically in order to adjust the height at which the opening 62 of the soap container 18 is disposed. When the locking nut 216 is tightened, a compression ring 218 disposed between the locking nut 216 and the extension tube 214 is compressed in order to fluidically seal the resulting joint. As a result of the above, the height of the soap container 18 is able to be adjusted to fit an orientation of elements for a specific system.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

Further, the individual components discussed above are not limited to any material. That is, each component may independently be made from any material such as, but not limited to, metal, plastic, wood, etc.

It is intended that the appended claims cover all such additions, modifications and rearrangements. Expedient embodiments of the present invention are differentiated by the appended claims.

What is claimed is:

1. A soap dispenser system comprising:

a fixture disposed above a countertop, the fixture comprising:

a fixture main body having a soap dispensing element, the fixture main body including a support plate unitary therewith and extending inward from an inner surface of the fixture main body; and a fixture mount attached to the countertop, the fixture mount including an indication system and a refill port;

a collar formed from a translucent material, the collar being disposed between the fixture mount and the countertop and within a recess formed within an outer surface of the fixture mount so that a bottom surface of the collar is in contact with the countertop and a top surface of the collar is in contact with the fixture mount, the recess having a depth equal to a thickness of the collar;

wherein the fixture main body is removably coupled to the fixture mount to expose the refill port; and a soap container disposed below the countertop and fluidically coupled to the soap dispensing element via a fluid supply line;

wherein the indication system is configured to indicate a power status of the system and a level status of the soap container; and wherein the fluid supply line extends from the soap dispensing element to a first fluid connector, the first fluid connector disposed within a slot of the support plate, the first fluid connector configured to detachably couple with a second fluid connector disposed within the fixture mount at a location surrounding the refill port.

2. The soap dispenser system of claim 1 wherein the fluid supply line is disposed within the fixture main body.

3. The soap dispenser system of claim 2 wherein when the fixture main body is removed from the fixture mount, the first and second fluid connectors detach.

4. The soap dispenser system of claim 1 wherein the indication system comprises a an illumination device disposed adjacent the collar and configured to illuminate the entire collar.

5. The soap dispenser system of claim 4 wherein the soap container includes a low soap level sensor and a high soap level sensor;

wherein the illumination device is configured to provide a visual low soap level indication when the low soap level sensor detects a low soap level; and wherein the illumination device is configured to provide a visual high soap level indication when the high soap level sensor detects a high soap level.

6. The soap dispenser system of claim 5 wherein the indication system further includes an audible device to provide an audible high soap level indication when the high soap level sensor detects the high soap level.

7. The soap dispenser system of claim 4 further including a power supply, wherein the illumination device is configured to provide a visual low battery level indication when the power supply is at a low battery level.

8. A soap dispensing fixture comprising:

a main body having a soap dispensing element fluidically coupled to a soap container via a fluid supply line, the fluid supply line including a first fluid connector disposed at a distal end thereof, the first fluid connector couple to a support plate extending from an inner surface of and unitary with the main body; and a mount secured to a countertop, the mount including an indication system, a refill port fluidically coupled to the soap container, and a second fluid connector disposed outside a perimeter of the refill port, wherein the indication system provides a visual indication of at least one of a soap level and a battery level, and wherein the first and second fluid connectors are detachably coupled to each other at a location above the countertop;

a collar formed from a translucent material, the collar being disposed between the mount and the countertop and within a recess formed within an outer surface of the mount along an entire perimeter of the mount so that a bottom surface of the collar is in contact with the countertop and a top surface of the collar is in contact with the fixture mount, an outer surface of the collar being aligned with the outer surface of the mount;

wherein the main body is removably coupled to the mount and configured to transition between an open orientation and a closed orientation.

9. The soap dispensing fixture of claim 8 wherein the indication system includes an illumination device configured to illuminate the collar.

10. The soap dispensing fixture of claim 9 wherein the illumination device provides a visual indication of a low soap level and a visual indication of a high soap level.

11. The soap dispensing fixture of claim 10 wherein the indication system provides an audible warning of the high soap level.

12. The soap dispensing fixture of claim 8 further comprising a locking mechanism configured to maintain the main body and the mount in the closed orientation.

13. The soap dispensing fixture of claim 8 further comprising a proximity sensor configured to detect whether the main body and the mount are in the closed orientation or the open orientation.

14. The soap dispensing fixture of claim 13 wherein the proximity sensor is configured to prevent activation of the soap dispensing element when the main body and the mount are in the open orientation.

15. The soap dispensing fixture of claim 8 wherein the mount includes a plurality of supports extending upward from the mount and into the main body when the main body and the mount are in the closed orientation.

16. The soap dispensing fixture of claim 8 wherein the second fluid connector is configured to:

couple with the first fluid connector when the main body and the mount are in the closed orientation; and detach from the first fluid connector when the main body and the mount are in the open orientation.

17. A soap dispenser system comprising:

a fixture including:

a mount coupled to a countertop, the mount including:

an upper mount portion disposed above the countertop;

a lower mount portion disposed below the countertop;

a refill port; and a collar disposed adjacent a top surface of the countertop, the collar formed of a translucent material surrounding the refill port and having an outer surface aligned with an outer surface of the upper mount, the collar disposed within a recess formed within the outer surface of the upper mount portion so as to be sandwiched between the upper mount portion and the countertop; and an indication system including an illumination device disposed adjacent the translucent collar;

a main body removably coupled to and extending upward from the mount, the main body including a soap dispensing element and a fluid supply line extending from the soap dispensing element to a first fluid connector, the first fluid connector disposed within a slot formed in a support plate unitary with the main body and extending from an inner surface of the main body above the countertop, the first fluid connector including an upper flange disposed above the slot and a lower flange disposed below the slot, each of the upper and lower flanges sized larger than the slot to extend beyond the slot;

wherein the mount and main body are configured to transition between an open orientation and a closed orientation;

a second fluid connector disposed at a location above the countertop and not coaxially aligned with the refill port and configured to detachably connect with the first fluid connector;

a soap container fluidically coupled to the soap dispensing element via the fluid supply line and refillable via the refill port; and a high soap level sensor and a low soap level sensor in communication with the soap container for indicating a soap level.

18. The soap dispenser system of claim 17 wherein the indication system provides a visual indication of a low soap level determined by the low soap level sensor and a high soap level determined by the high soap level sensor; and wherein the indication system may further provide an audible warning of the high soap level determined by the high soap level sensor.

19. The soap dispenser system of claim 17 wherein the fixture further includes a locking mechanism having a locked position configured to maintain the main body and the mount in the closed orientation.

20. The soap dispenser system of claim 17 wherein a front surface of the collar is flush with a front surface of the mount.

* * * * *